US007721630B2

(12) United States Patent
Hunter

(10) Patent No.: US 7,721,630 B2
(45) Date of Patent: May 25, 2010

(54) AUTOMATIC SIZING ONE-HANDED LOCKING PLIERS

(75) Inventor: Robert E. Hunter, Virden, IL (US)

(73) Assignee: Marc W. Hunter, Webster Groves, MO (US)

( * ) Notice: Subject to any disclaimer, the term of this patent is extended or adjusted under 35 U.S.C. 154(b) by 355 days.

(21) Appl. No.: 11/637,965

(22) Filed: Dec. 13, 2006

(65) Prior Publication Data

US 2007/0089572 A1 Apr. 26, 2007

Related U.S. Application Data

(63) Continuation-in-part of application No. 11/052,509, filed on Feb. 7, 2005, now Pat. No. 7,146,887.

(51) Int. Cl.
*B25B 7/12* (2006.01)
*B25B 7/00* (2006.01)
*B25B 7/22* (2006.01)

(52) U.S. Cl. ..... 81/367; 81/380; 81/301; 7/127

(58) Field of Classification Search ..... 81/380, 81/301, 399; 7/127
See application file for complete search history.

(56) References Cited

U.S. PATENT DOCUMENTS

| | | | | | |
|---|---|---|---|---|---|
| 2,478,696 | A * | 8/1949 | Isele | 81/380 |
| 2,487,281 | A * | 11/1949 | Steckelberg | 81/301 |
| 2,499,201 | A * | 2/1950 | Thayer | 81/380 |
| 2,592,807 | A * | 4/1952 | Jones | 81/369 |
| 2,705,899 | A * | 4/1955 | Berger | 81/371 |
| 3,104,571 | A * | 9/1963 | Trybus | 81/380 |
| 3,116,656 | A * | 1/1964 | Hostetter | 81/379 |
| 3,262,343 | A * | 7/1966 | Weller | 81/370 |
| RE26,280 | E * | 10/1967 | Hostetter | 81/379 |
| 3,354,759 | A * | 11/1967 | Cook | 81/379 |
| 3,600,986 | A * | 8/1971 | Baldwin | 81/370 |
| 3,635,107 | A * | 1/1972 | Schmidt | 81/367 |
| 3,710,658 | A * | 1/1973 | Wilson | 81/367 |
| 4,297,756 | A * | 11/1981 | Lance | 7/127 |
| 6,012,361 | A * | 1/2000 | Wooster et al. | 81/367 |
| 6,408,724 | B1 * | 6/2002 | Whiteford | 81/367 |
| 6,708,588 | B2 * | 3/2004 | Kesinger et al. | 81/380 |
| 7,146,887 | B2 * | 12/2006 | Hunter | 81/367 |
| 2002/0157507 | A1 * | 10/2002 | Chou | 81/367 |

* cited by examiner

*Primary Examiner*—Joseph J Hail, III
*Assistant Examiner*—Alvin J Grant
(74) *Attorney, Agent, or Firm*—Matthews Edwards LLC

(57) ABSTRACT

An automatically adjustable locking pliers or tool includes a jaw fixed to a first handle and a jaw that pivots about the first handle. The pivoting jaw is connected to a lower tightening handle. A lever connects the tightening handle and first handle. A self-adjusting sizing and locking mechanism includes a thumb jaw sizing piece located near the jaws and movable to open the jaws so that they can be sized around a workpiece. When the thumb jaw sizing piece is released, the jaws automatically size and clamp lightly around the workpiece. The locking mechanism uses balls between a locking rod and a tapered surface. Locking occurs when the balls wedge between the rod and the tapered surface. A release cylinder is connected to a release paddle movable to unlock the mechanism. The sizing piece and locking mechanism are operable to automatically size and lock the pliers or tool.

5 Claims, 6 Drawing Sheets

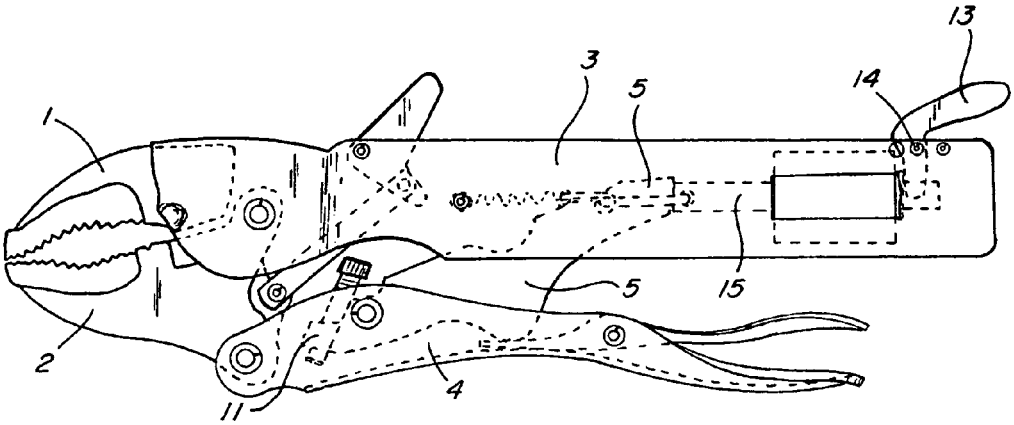
Fig. 2
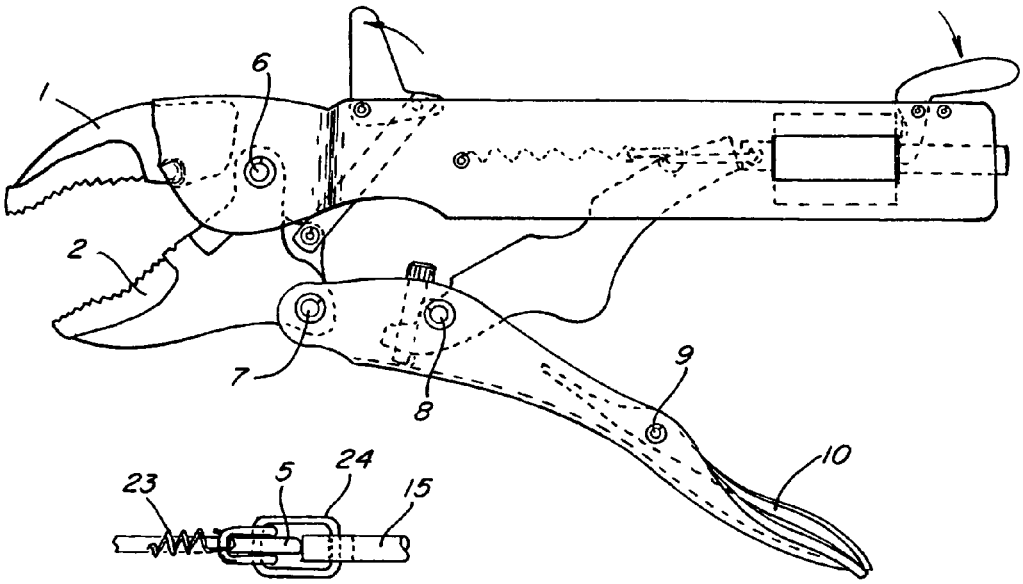
Fig. 3
Fig. 1

AUTOMATIC SIZING ONE-HANDED LOCKING PLIERS

This application is a continuation-in-part of U.S. application Ser. No. 11/052,509, filed Feb. 7, 2005 now U.S. Pat. No. 7,146,887.

BACKGROUND OF THE INVENTION

This invention relates to the field of tools for mechanical work. More particularly, an automatically sized one-handed locking plier is presented.

Locking pliers have been sold in their standard form for decades with little significant improvements. While the pliers perform wonderfully and are a staple in every toolbox around the world, certain improvements would make the locking pliers even more useful. Locking pliers differ from ordinary pliers in that they contain a mechanism to lock the jaws of the pliers onto the work piece. Many different types of locking pliers have been produced, and they are commonly known in the trade as Vise-Grips.RTM. or simply "locking pliers".

Some of the problems with locking pliers include the fact that they are tedious in use, since iterative screw adjustments must be made to size the jaws to the part.

Pliers that can be easily operated with one hand and that automatically size the jaws to the part, but still provide the quality and clamping force of the standard locking pliers, would provide an advancement in the ease of use and utility of the pliers.

Examples of useful locking plier tools are found in various United States patents of general interest in the field.

One good example of a locking plier tool is found in the 2000 United States patent issued to Warheit, U.S. Pat. No. 6,095,019. Warheit discloses the typical locking plier tool used to clamp onto a work piece. The Warheit device has a thumb actuated control member which facilities work piece pressure adjustment and tool release by one hand. The typical locking pliers, as shown in the patent issued to Warheit and other U.S. patents, include an upper jaw that is permanently attached to an elongated body. A lower jaw is pivotably attached to the locking pliers as well as a lower handle tightening mechanism. A pivoting lever normally connects the upper body and lower tightening mechanism. The pliers are usually tightened for work piece sizing and for grip strength by a thumbscrew mechanism, generally found at the end of the upper body handle.

Several problems have been encountered in the use of previous tools and improvements could prove beneficial. One such problem is that while the tools must be sized to fit the work piece, the sizing is usually done by a thumbscrew mechanism that requires both hands to operate the mechanism. One hand is needed to hold the locking pliers onto the work piece while the other hand is needed to turn the thumbscrew adjustment. It is a primary object of this invention to provide a locking plier type of hand tool that automatically sizes the jaws of the locking pliers onto the work piece.

Another problem with the locking pliers heretofore known in the art is that the sizing of the pliers onto the work piece has a direct correlation to the hand pressure or gripping pressure used to lock the pliers onto the piece. Once the pliers have been sized approximately, a further manipulation of the adjusting thumbscrew would be necessary to adjust the handle grip strength. It is another object of this invention to provide a locking plier that not only automatically sizes the jaws to the workpiece, but also has an adjustment screw, operable by the same hand that holds the pliers, for adjusting the handgrip strength to a set handgrip for each workpiece.

Another major drawback in the use of ordinary locking pliers is that the handgrip strength tensioning mechanism and the sizing mechanism require both hands of the mechanic. Since both hands are needed to attach and tighten the pliers to the workpiece, the task of adjusting the locking pliers is both cumbersome and time consuming. It is a still further object of this invention to provide a locking pliers wherein the use of the pliers is conveniently and quickly accomplished so that the workman uses little or no time when changing from one work piece to another.

A final aspect of this invention allows the locking plier to remain loosely gripped around the work piece when the pliers have been released into their open position. This is a particularly useful feature of the locking plier mechanism of the instant invention since it allows the workman to remove the wrench, with one hand, at the workman's convenience. This feature eliminates the wrench falling on the workman if he is an awkward position. Further in connection with this capability, another advantage of the invention is that releasing the pliers can be accomplished with exertion of a relatively light force, even when the pliers are set to a high gripping or clamping force, as the required release force is not a function of the gripping force. Thus, a further object of the invention is the capability to more easily release the pliers, yet still provide a loose gripping force for holding the pliers on a work piece.

Other and further objects of this invention will become obvious upon reading the below described specification.

BRIEF DESCRIPTION OF THE DEVICE

The locking pliers device described has the basic structure of a locking pliers, including an upper fixed jaw connected to an upper body handle and a lower pivoting jaw connected to the upper handle by a middle lever. A lower pivoting handle is connected to the middle lever and the lower jaw. An improvement to existing locking pliers includes an adjusting screw-type mechanism that is placed near the pivot point between the lower handle and middle lever to adjust the grip strength (or clamping force) of the locking pliers. Within the upper body handle is another improvement, a workpiece automatic sizing and locking mechanism. The unique locking mechanism includes a tapered metal housing containing ball bearings that surround a locking rod (or plunger). The locking rod is spring biased towards the jaws and may be locked in place when the ball bearings are forced against the outer surface of the rod. The locking rod abuts the middle lever and pushes against it. A palm handle, located at the end of the body of the locking pliers, allows to the workman to release the locking rod by pushing the palm handle downwards. A thumb operated sizing lever is also located within the upper body and is connected by a linkage to the lower jaw. The pliers are sized and locked to a workpiece by opening the spring-loaded jaws with the thumb lever, releasing the thumb lever, and squeezing the lower handle towards the upper body. The thumb lever and locking rod automatically adjust the jaw size and lock the pliers to the workpiece. The lower paddle releases the jaws, and is configured so as to be operable with a relatively light force, but they remain lightly closed on the workpiece until the workman opens them by pushing on the thumb lever.

BRIEF DESCRIPTION OF THE DRAWINGS

FIG. 1 is a side view of the locking pliers shown with the jaws in the open position;

FIG. 2 is a side view of the locking pliers showing the pliers in the closed position;

FIG. 3 is a top view of the adjusting rod and biasing spring linkage;

DETAILED DESCRIPTION OF THE INVENTION

Figure 4:
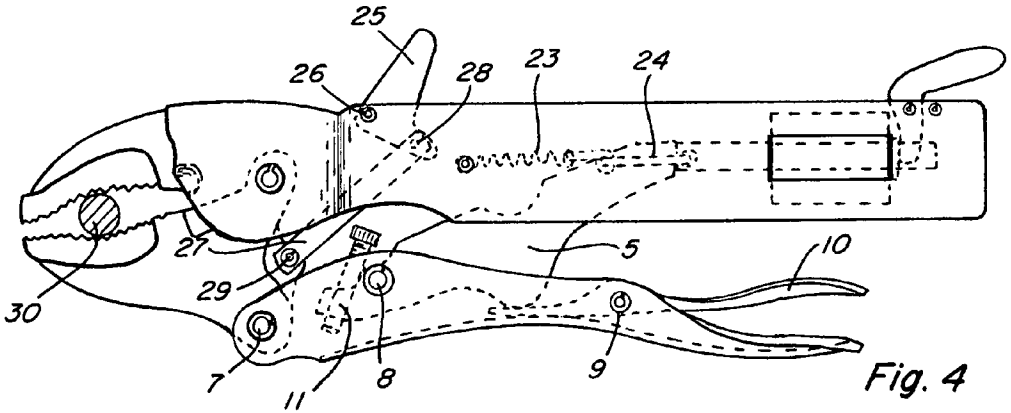
FIG. 4 is a side view of the locking pliers showing it in its closed and locked position around a work piece.

This invention has, generally, the outward appearance and general structure of an ordinary type of locking pliers. The basic structure of the invention includes a fixed permanent jaw 1 permanently attached to an elongated upper body handle 3, as best shown in FIG. 1. Pivotably connected to the fixed upper jaw and body handle is a rotating lower jaw 2. Attached to the lower pivoting jaw 2 is a lower pivoting handle 4. The lower pivoting handle 4 is connected to the upper body handle 3 by a middle lever 5. The middle lever 5 is irregularly shaped as shown in the drawing figures.

In order for this locking plier to function in a unique fashion, a number of pivot points are required. The lower jaw is connected to the upper jaw at pivot point 6. The lower jaw and the lower handle are connected at pivot point 7. The lower handle and middle lever are connected at pivot point 8. The lower handle also has a lower release paddle 10. This lower release paddle 10 is connected to the lower handle at lower paddle pivot point 9. In common use, one places the jaws 1 and 2 around the workpiece and pulls upwardly on the lower pivoting handle 4. This presses the middle lever 5 upward into the upper body handle 3 and locks the jaws onto the workpiece. While this structure is common in the art, the basic structure of the locking pliers has been improved with the addition of the below described components.

A grip strength, or clamping force, adjusting screw 11 is located at the bottom portion of the middle lever 5 as best shown in drawing FIGS. 1 and 4. This grip-tension adjusting screw 11 is threaded into the lower part of the middle lever 5 and extends downwardly from the middle lever to the lower inner surface of the lower pivoting handle 4 at a tightness that is predetermined by the workman. The tightness between the lower handle 4 and the adjusting screw 11 determines the grip strength, or clamping force, required to lock the jaws on the workpiece. The tighter the screw is adjusted against the lower surface of the lower handle 4, the easier it is to tighten the pliers, that is, the lighter the gripping force. The looser the screw is adjusted, the heavier the gripping force.

The locking and sizing mechanisms of the adjustable pliers described herein allow the jaws of the pliers to automatically size themselves to the workpiece. This is a key and most unique feature of this invention.

The locking mechanism is located at the end of the upper body handle away from the jaws. This free end of the upper body handle contains a palm lever 13 as shown in FIG. 2. This palm lever 13 is pivotably connected to the free end of the upper body handle at pivot point 14, as shown on FIG. 6. The palm lever releases the jaws from the workpiece as will be described later.

Figure 6:
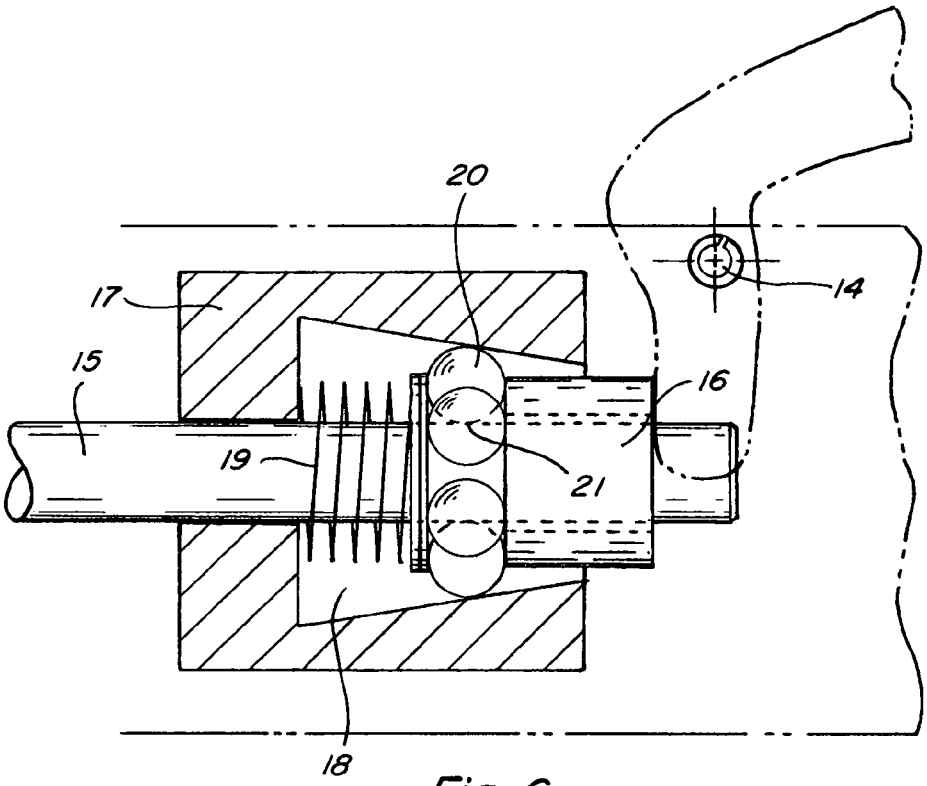
FIG. 6 is an expanded cross sectional view of the workpiece locking mechanism shown in its locked position.
Figure 7:
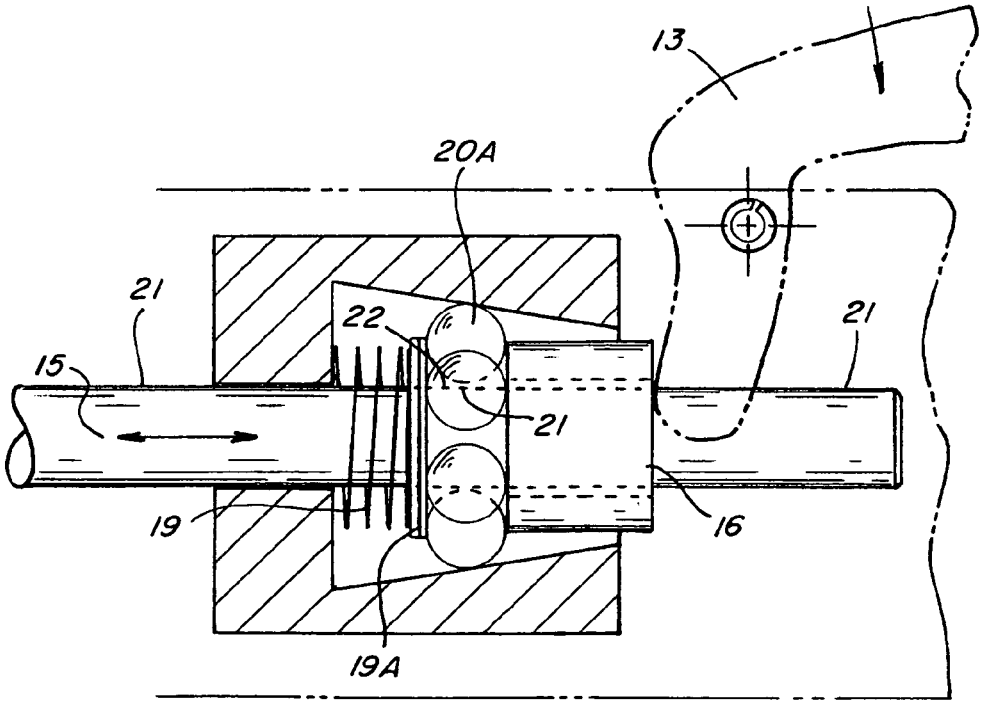
FIG. 7 is an expanded cut-away view of the workpiece locking mechanism shown in its unlocked position.

Turning to FIGS. 6 and 7, the locking mechanism is shown. The locking mechanism has a horizontal locking rod 15. This adjusting rod slides within a sleeve 16. The locking rod 15 slides through the tapered tightening walls 17. The tapered tightening walls consist of a solid structure containing a tightening chamber 18. It is essential to this invention that the tightening chamber 18 have the trapezoidal inner configuration as shown in FIG. 6 and 7. The inner tightening chamber 18 slopes downwardly towards the free end and away from the jaw end of the locking pliers. Located within the tightening chamber 18 are a number of bearings 20. The bearings 20 are biased towards the free end of the upper body handle 3 and away from the jaw end by tension spring 19. The tensioning spring 19 may also have tensioning spring washers 19A that would be in direct contact with the ball bearings 20.

The locking rod 15 has an upper rod surface 21. This upper rod surface 21 has an end that protrudes out of the locking mechanism and towards the jaws, and an end that protrudes out of the locking mechanism and towards the free end of the locking pliers. The locking rod 15 moves towards the jaws or away from the jaws as shown in the arrow on FIG. 7.

In order to lock the rod 15 in a position such that the jaws may lock around a workpiece, the bearings 20 must be in contact with the rod surface 21 and the walls of the tightening chamber 18, as shown in the locked position in FIG. 6. As can be seen from FIG. 6, when the bearings 20 are locked between the surface 21 of the rod and the walls of the tightening chamber 18, due in part to the force of the tension spring 19, the rod will not move.

In order to release the jaws, one releases the bearings from the surface of the rod. To accomplish this release, one simply depresses the palm lever 13. Depressing the palm lever 13 moves the adjusting sleeve 16 from right to left on the drawing figures. This action depresses the spring 19 and moves the ball bearings 20 from right to left on the drawing figures. The locking chamber tapers downwardly towards the free end of the handle. Since the locking chamber 18 has a trapezoidal shape as shown, the balls release from the rod when the palm handle 13 is depressed. The locking rod 15 is then allowed to move freely within the sleeve 16 and locking walls 17.

When the jaws are unlocked they can be released from the workpiece. As best shown in FIG. 7, when ball bearings 20A are separated from the surface 21 of rod 15, the separation 22 allows the rod to move from left to right as shown in FIG. 7. While the jaws remain lightly gripped around the workpiece, they can be easily removed from the workpiece by the thumb lever 25 once the locking mechanism has been released as described above.

The workpiece locking rod 15 has one end free, located away from the jaws as shown in FIG. 4. A locking rod biasing spring 23 has one end connected inside the upper body handle 3 and another end connected to the jaw end of the locking rod 15 by a linkage mechanism. This linkage mechanism is best shown in FIG. 3.

As shown in FIG. 3, the jaw end of the locking rod 15 is connected to the linkage 24. The linkage 24 is also connected to the tightening biasing spring 23. The tensioning rod 15 is in contact with and abuts the upper end of the middle lever 5. While the locking rod 15 and lever 5 are in contact, they are not pivotably connected but are rather slidably and rotatably in contact with each other as shown in FIG. 3. The biasing spring 23 biases the locking rod towards the jaw end of the pliers as shown in FIGS. 3 and 4.

Another important aspect of this device is the automatic adjustment of the jaws to the outside dimension of the workpiece. The design of the pliers as described herein allows the user to automatically size the jaws to the workpiece with one hand. The locking mechanism and the sizing mechanism cooperate together to accomplish this.

A sizing thumb lever 25 operates to open the spring-loaded jaws for placement around the workpiece. Releasing the thumb lever then allows the jaws to clamp to the part. The jaws are automatically sized. This automatic sizing mechanism is best shown in FIG. 4.

As shown in FIG. 4, a thumb jaw sizing and release lever 25 has the shape of a boot. This thumb jaw lever 25 is pivotably connected to the upper body handle at the boot heel at pivot point 26. The thumb jaw lever 25 is also connected to a thumb jaw release and lower jaw linkage 27. This lower linkage 27 is pivotably connected to the toe end of the boot 25 at pivot point 28. The lower end of the jaw linkage 27 is pivotably connected to the lower jaw at pivot point 29. Once the pliers are unlocked, as shown in FIG. 1, the thumb jaw release lever 25 is pushed forward (in the embodiment as shown in FIG. 4). The linkage 27 then pulls the lower jaw 2 open to release the workpiece 30 completely.

As shown in FIG. 4 the work piece 30 can be a circular steel rod. Alternatively, the work piece could be a hex nut, a screw, a pipe, or any other type of work piece commonly encountered in the field. When the user pushes the thumb jaw sizing and release lever 25 towards the jaw end of the locking pliers, the spring-loaded jaws open. When the thumb lever is released, the jaws clamp lightly onto the part until the pliers are locked.

Once the locking pliers have been locked onto a workpiece 30, they may be released by depressing the lower release paddle 10 downwardly towards the lower pivoting handle 4. The release paddle 10 pivots about pivot point 9. The jaw end of the release paddle 10 comes into contact with the irregularly shaped humped portion of the middle lever 5, as shown on FIG. 4. This middle lever 5 is then forced upwardly and toward the jaw end of the pliers. This motion releases the upper and lower jaws. An advantage of the present construction is that the releasing action can be accomplished with exertion of a relatively light force, even when the pliers are set to a high gripping or clamping force, as the required effort to release lever 5 is not a tied or otherwise a function of the gripping force. However, unlike the standard type of locking pliers currently in use the spring-loaded jaws remain lightly closed on the part until the user opens them by pulling back the thumb jaw release 25 as described above. It is believed that this combination of requirement of a relatively light releasing force, with the jaws remaining lightly closed around a workpiece is anther important advantage of the pliers of the present invention.

Once the jaws have been automatically sized and clamped to the part, the pliers act similarly to other locking pliers in that squeezing the lower handle towards the upper main body creates the clamping force and locking of the pliers. However, the clamping force required to lock the pliers may be preset by the user and can be adjusted through turning the adjusting screw 11, as previously described. This adjustment of the clamping force by the adjustment of one dedicated screw is unique to the locking pliers art. In normal locking pliers, one screw adjusts both the clamping force and also sizes the jaws.

Figure 5:
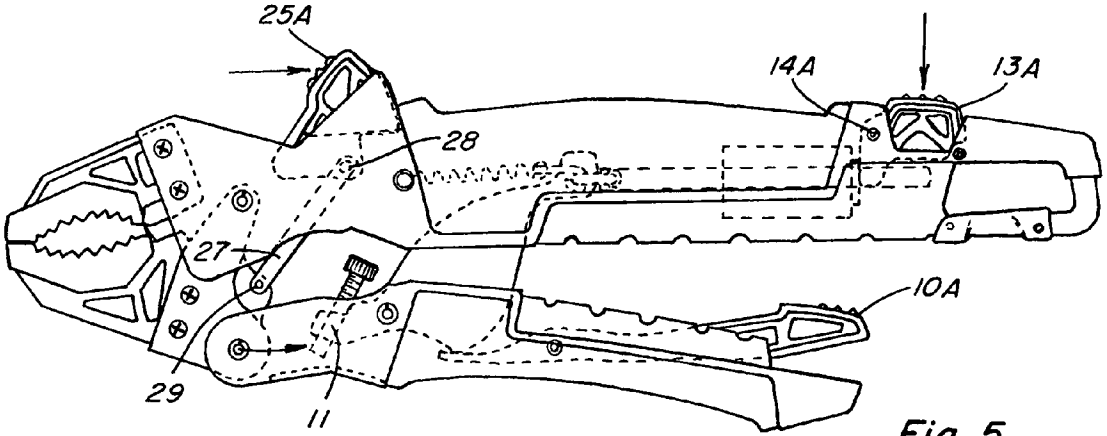
FIG. 5 is a side view of the locking pliers in an alternate embodiment showing slightly different palm handle and thumb lever mechanisms.

An alternate embodiment of the device in shown in FIG. 5. In this alternate embodiment, the L shaped palm lever 13 of the embodiment shown in FIG. 4 is replaced with a palm button 13A. The main difference between the two pieces 13 and 13A is that the palm piece 13A, shown in FIG. 5, is flat and is more ergonomically designed.

Another difference in the second embodiment is the use of an alternate thumb jaw piece 25A. In place of the pivoting boot 25, shown in the embodiment of FIG. 4, a sliding thumb jaw piece 25A is provided. The alternate thumb jaw piece 13A moves upwardly when the user slides the thumb jaw piece 25A upwardly. This action moves the linkage 27 upward, which opens the lower jaw 2. The thumb jaw piece 25A is designed to be pulled upward on a slant as shown in FIG. 5.

Alternatively, a second thumb jaw piece pivot could be provided such that the thumb jaw piece pivots when the piece 25A is depressed by the user's thumb. Depressing the piece 25A would pull the linkage 27 upwards, releasing the lower jaw.

In the embodiment in FIG. 5, a more ergonomically designed lower release paddle 10A also replaces the standard release paddle 10. While the second, alternate embodiment shown in FIG. 5 has the above slight modifications, the main and essential parts of the device remain the same in both embodiments.

Figure 8:
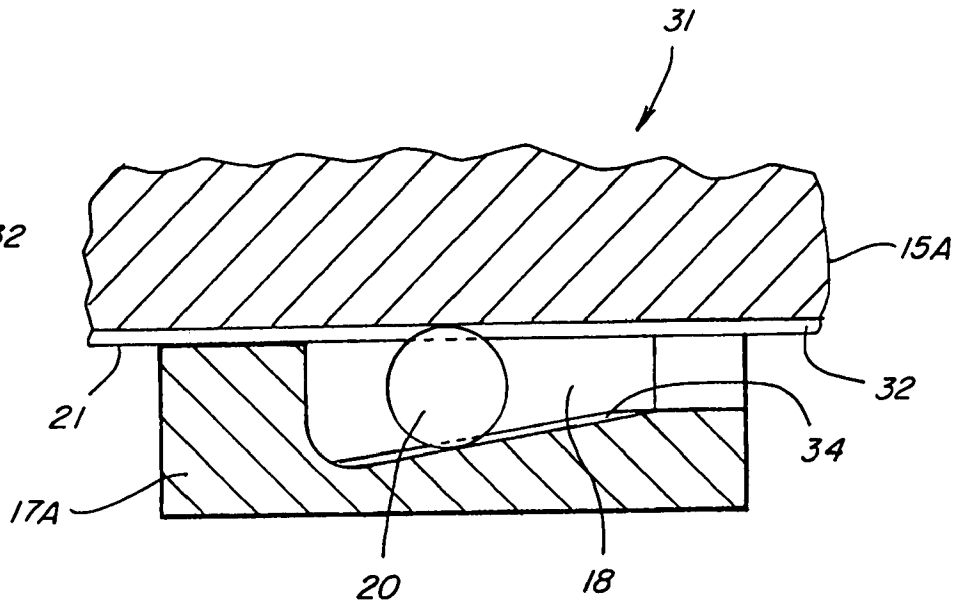
FIG. 8 is a fragmentary sectional view of an alternative locking mechanism.
Figure 9:
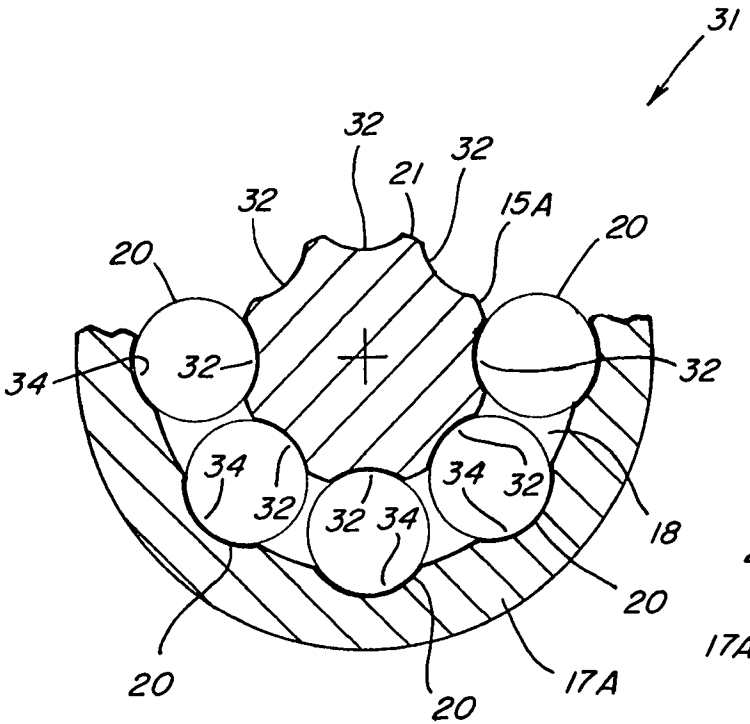
FIG. 9 is another fragmentary sectional view of the alternative locking mechanism.

In FIGS. 8 and 9, an alternative locking mechanism 31 according to the invention is shown, including a locking rod 15A including longitudinally extending grooves 32 disposed at angular locations around surface 21 thereof, each of grooves 32 being configured for receiving a bearing 20 (or 20A) for longitudinal movement relative thereto (sleeve 16, spring 19 and spring washer 19A being deleted for clarity). Tapered tightening walls 17A includes matching longitudinal grooves 34 located at angular locations corresponding with those of grooves 32 in the surface of locking rod 15A, so as to also receive bearings 20. Grooves 32 and 34 preferably have a curved profile shape when viewed longitudinally which is sized so as to correspond at least largely to the curved profile and size of individual bearings 20. Locking mechanism 31 illustrated here operates in essentially the same manner as the locking mechanism described above. Grooves 32 and 34 can be uses together or singly, and are advantageous as they more positively position and hold bearings 20 at the desired angular positions around rod 15A, increase the area of surface contact between the bearings and rod 15A and tightening walls 17A to provide increased holding capability, and reduce stress concentrations, particularly in the bearings.

Figure 10:
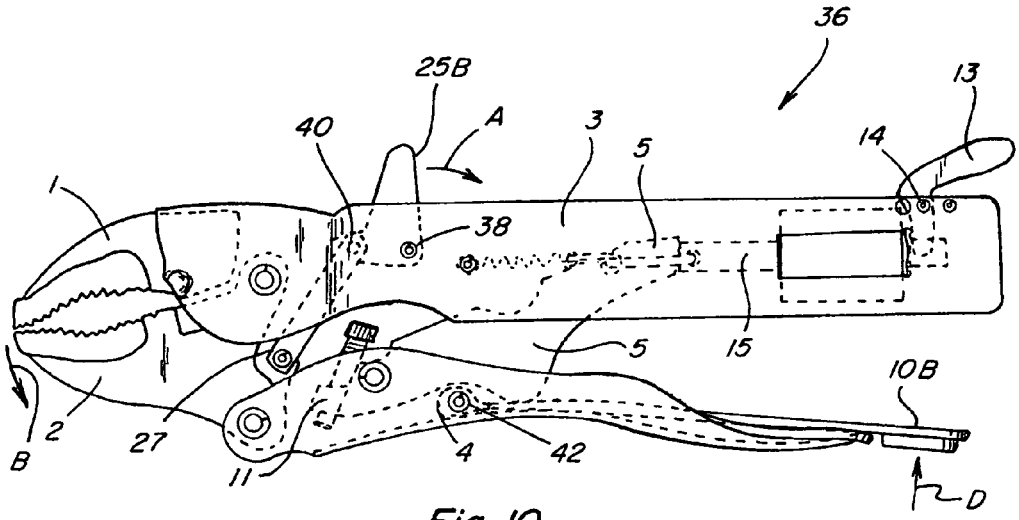
FIG. 10 is a side view of the locking pliers in another alternative embodiment showing a thumb lever and a release paddle pivotable about different pivot points.
Figure 11:
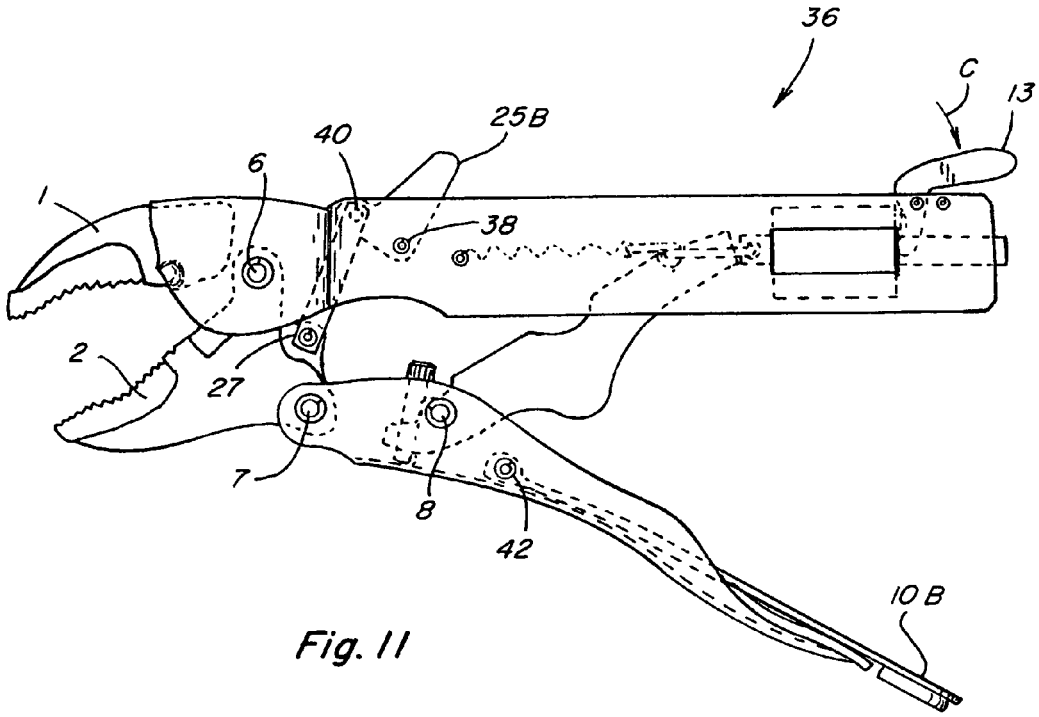
FIG. 11 is a side view of the locking pliers of FIG. 10 with the jaws opened.

In FIGS. 10 and 11, another alternate embodiment 36 of the device is shown. Embodiment 36 is shown including L shaped palm lever 13 of the embodiment shown in FIG. 4, although alternatively, palm piece 13A shown in FIG. 5, could be used. A difference in embodiment 36 is the use of an alternate thumb jaw sizing and release piece 25B. In place of the pivoting boot shaped lever 25 shown in the embodiment of FIG. 4, and sliding thumb jaw piece 25A of FIG. 7, thumb jaw piece 25B is moved rearwardly as denoted by arrow A, away from jaws 1 and 2, to move linkage 27 upward, to open lower jaw 2, as denoted by arrow B. Movement down, as denoted by arrow C, of palm lever 13 about pivot point 14 will release locking rod 15, to allow sizing of jaws 1 and 2, as explained above. Thumb jaw piece 25B is pivotally mounted in body handle 3 at a pivot joint 38, and it is pivotally connected to linkage 27 at a pivot joint 40. The clamping force required to lock the pliers may be preset by the user and can be adjusted through turning the adjusting screw 11, as previously described.

Also in embodiment 36 in FIGS. 10 and 11, another alternative release paddle 10B replaces release paddle 10 and 10A shown above. Again, jaw 2 is pivotally connected to handle 3 at pivot point 6. Handle 4 is pivotally connected to jaw 2 at pivot point 7. Middle lever 5 is pivotally connected to handle 4 at pivot point 8. However, release paddle 10B is now pivotally connected to handle 4 at a pivot joint 42, closer to jaws 1 and 2 than the irregularly shaped humped portion of middle lever 5. Once the locking pliers have been locked onto a workpiece, they may be released by moving release paddle 10B upwardly, as denoted by arrow D, toward handle 3. The release paddle 10B pivots about pivot point 42. The surface of release paddle 10B comes into contact with the irregularly shaped humped portion of middle lever 5, which is forced thereby upwardly and toward the jaw end of the pliers. This motion releases the upper and lower jaws. As stated above, an advantage of this construction is that the releasing force or effort required is relatively light, and is not a function of the gripping force. However, again, as above, unlike the standard type of locking pliers currently in use, the spring-loaded jaws remain lightly closed on the part until the user opens them by moving thumb jaw release 25B, here, in direction A.

Figure 12:
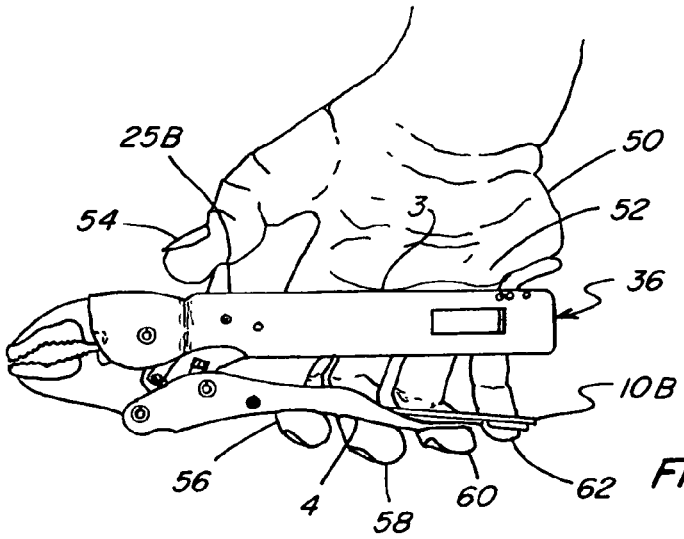
FIG. 12 is another side view of the locking pliers of FIG. 10 held in a person's hand.
Figure 13:
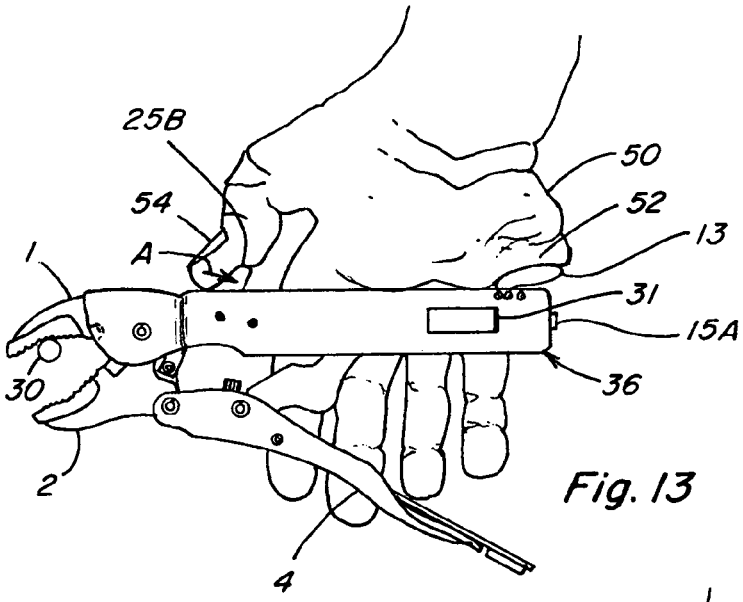
FIG. 13 is another side view of the locking pliers with the heel of the palm of the person's hand depressing the palm lever and the thumb of the person's hand operating the thumb lever for sizing the jaws of the pliers to a workpiece.
Figure 14:
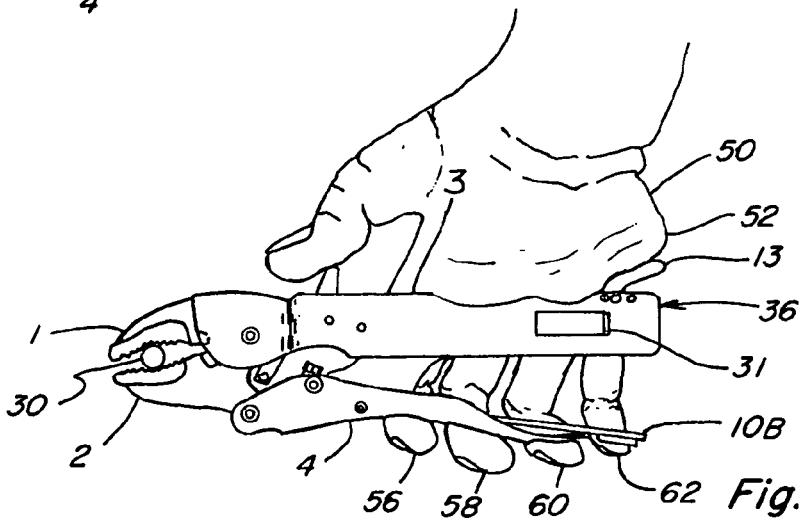
FIG. 14 is still another side view of the locking pliers in the person's hand, showing the pliers locked onto the workpiece.

Turning to FIGS. 12, 13 and 14, one-handed operation of embodiment 36 of the locking pliers of the invention, is illustrated. In FIG. 12, a user's hand 50 is shown grasping the locking pliers 36. Heel 52 of the palm of hand 50 is in contact with handle 3, with thumb 54 on thumb jaw piece 25B. Forefinger 56 contacts pivoting handle 4, as does middle finger 58 and ring finger 60. Pinky finger 62 is positioned for pushing release paddle 10B. In FIG. 13, heel 52 of the palm of hand 50 pushes palm lever 13 down, to release locking mechanism 30. Handle 4 is lowered. Thumb 54 pushes thumb piece 25B in direction A, as required to size jaws 1 and 2 about a workpiece 30. In FIG. 14, jaws 1 and 2 are sized to workpiece 30, and heel 52 of hand 50 allows palm lever 13 to raise, thereby allowing locking mechanism 31 to lock rod 15A in position. Handle 4 is squeezed toward handle 3 by fingers 56, 58 and/or 60, to apply the clamping force to jaws 1 and 2 in the above-described manner for tightly clamping workpiece 30 to the desired or set extent. The clamping force can now be released by movement of release paddle upwardly toward handle 3, for instance, using fingers 60 and/or 62. Again, the required release force, is independent of the set gripping force, and is relatively light. Jaws 1 and 2 can then be released and removed from workpiece 30, or resized thereto, by depressing palm lever 13 and moving thumb piece 25B.

It should be understood that directional references herein, such as, but not limited to, front, forward, rear, up, down, lower, upper, and the like, are used for reference purposes only, and are not to be considered as limiting. Similarly, anatomical prefixes such as "thumb", "palm" and the like are used for reference purposes only, and also are not to be interpreted as limiting. For example, it is contemplated that "thumb" pieces 25, 25A and/or could be moved or manipulated using other parts of the hand, such as the forefinger or another finger. Similarly, "palm" lever 13 is contemplated to be movable using a finger or other portion of the hand. It should also be understood that the teachings of the present invention can be embodied in a variety of locking pliers constructions in addition to those described above and shown in the drawings. For instance, the shape of jaws 1 and/or 2 can be widely varied for use in a variety of applications, for instance, but not limited to, so as to have a needle nose shape, and the jaws can be attached connected or formed in connection with the tool in any suitable manner, including, for instance, with fasteners, die casting, forging, welding and the like. The invention is also not limited to locking pliers of a particular size.

Further, the locking mechanism described in this application is not unique only to locking pliers, but could also be integrated into other tools such as crescent wrenches, channel locks, pipe wrenches, or other types of wrenches that may be locked. The mechanism disclosed herein can be applied to the entire pliers line with the various jaws fit to a standard body. This high quality and innovative tool could render the existing locking pliers obsolete and become the new standard locking device in every tool box for years to come.

It will be understood that changes in the details, materials, steps, and arrangements of parts which have been described and illustrated to explain the nature of the invention will occur to and may be made by those skilled in the art upon a reading of this disclosure within the principles and scope of the invention. The foregoing description illustrates the preferred embodiments of the invention; however, concepts, as based upon the description, may be employed in other embodiments without departing from the scope of the invention. Accordingly, the following claims are intended to protect the invention broadly as well as in the specific form shown.

What is claimed is:

1. An adjustable locking pliers, comprising:

a main body having a first jaw which is fixed in relation thereto, and a movable jaw pivotably attached to said main body by a middle lever; and a workpiece locking mechanism means comprising a locking rod having longitudinal grooves thereabout, the locking rod being biased towards said jaws and slidably received within a tapered chamber containing elements disposed partially in the grooves and disposed to bear against tapered tightening walls extending about and defining the tapered chamber, wherein said elements comprise bearings contained in a trapezoidal chamber tapered downwardly away from the jaw end of said pliers, said bearings being biased towards the smaller end of said chamber by a spring, such that the locking rod will be locked in a position in the chamber by immobilization of the elements thereagainst, and slidably released by mobilization of the elements, said rod in contact with one end of said middle lever, wherein said locking rod may be released by movement of a piece in contact therewith.

2. An adjustable locking pliers, comprising:

an upper jaw fastened to a main body, and a lower jaw pivotably attached to said main body by a middle lever;

a locking mechanism having a grooved locking rod biased towards said jaws and slidably received within a tapered chamber so as to be lockable therein by fixed engagement with elements located within grooves of the locking rod and immobilized against tapered locking walls disposed around and defining the tapered chamber, the locking mechanism being configured so as to be operable to release the elements and the locking rod so as to be movable within the tapered chamber, said rod being in contact with an upper end of said middle lever, wherein said locking mechanism is configured such that said locking rod is releasable by movement of a palm lever; and a thumb actuatable jaw sizing and release piece connected to the lower jaw by a linkage wherein movement of said release piece in a predetermined manner increases a jaw size of said pliers and releasing said release piece sizes the jaws to a workpiece.

3. An adjustable locking pliers as in claim 2, wherein an upper end of said linkage is pivotably connected to said release piece and a lower end of said linkage is pivotably connected to said lower jaw.

4. An adjustable locking tool, comprising:

a main body having a first jaw which is fixed in relation thereto, and a movable jaw pivotably attached to said main body by a middle lever; and a workpiece locking mechanism means comprising a locking rod biased towards said jaws and slidably received within a tapered chamber, the locking rod including an outer surface including grooves in which bearings are positioned, respectively, so as to be biasable against tapered walls disposed about the tapered chamber for locking the locking rod in a fixed position in the chamber, said bearings being biased towards a smaller end of said chamber by a spring, and wherein the locking rod can be slidably released, said rod in contact with one end of said middle lever, wherein said locking rod may be released by movement of a piece in contact therewith, and a sleeve surrounding said rod, wherein said piece is pivotally mounted so as to be capable of being pivoted against said sleeve to force said bearings toward the larger end of said chamber for releasing the locking rod.

5. An adjustable locking pliers, comprising:

a main body having a first jaw which is fixed in relation thereto, and a movable jaw pivotably attached to said main body by a middle lever; and a workpiece locking mechanism means comprising a locking rod having longitudinal grooves thereabout, the locking rod being biased towards said jaws and slidably received within a tapered chamber containing elements disposed partially in the grooves and disposed to bear against tapered tightening walls extending about and defining the tapered chamber, wherein said elements comprise bearings contained in a trapezoidal chamber tapered downwardly away from the jaw end of said pliers, said bearings biased towards the smaller end of said chamber by a spring, such that the locking rod will be locked in a position in the chamber by immobilization of the elements thereagainst, and slidably released by mobilization of the elements, said rod being in contact with one end of said middle lever, wherein said locking rod may be released by movement of a piece in contact therewith, and a sleeve surrounding said rod, wherein said piece is pivotally mounted so as to be capable of being pivoted against said sleeve to force said bearings toward the larger end of said trapezoidal chamber.

* * * * *